United States Patent [19]

Djordjevic

[11] Patent Number: 4,552,117

[45] Date of Patent: Nov. 12, 1985

[54] FUEL INJECTION PUMP WITH SPILL CONTROL MECHANISM

[75] Inventor: Ilija Djordjevic, Windsor, Conn.

[73] Assignee: Stanadyne, Inc., Windsor, Conn.

[21] Appl. No.: 658,887

[22] Filed: Oct. 9, 1984

[51] Int. Cl.[4] ..... F02M 37/04

[52] U.S. Cl. ..... 123/506; 123/450; 417/462

[58] Field of Search ..... 123/506, 450, 458, 459, 123/447; 17/462

[56] References Cited

U.S. PATENT DOCUMENTS 3,759,239 9/1973 Regneault et al. ..... 123/506

3,857,374 12/1974 Glikin et al. ..... 123/506

4,200,072 4/1980 Bailey ..... 123/501

4,376,432 3/1983 Davis ..... 123/501

*Primary Examiner*—Magdalen Y. C. Moy

*Attorney, Agent, or Firm*—Prutzman, Kalb, Chilton & Alix

[57] ABSTRACT

A rotary fuel injection pump with a rotor having pumping plungers reciprocated for supplying high pressure charges of fuel for fuel injection and a spill control mechanism having one or two rotary spill valves mounted on the rotor and rotated in unison with the rotor and in synchronism with the reciprocable movement of the pumping plungers for spill control of the high pressure charges of fuel.

29 Claims, 19 Drawing Figures

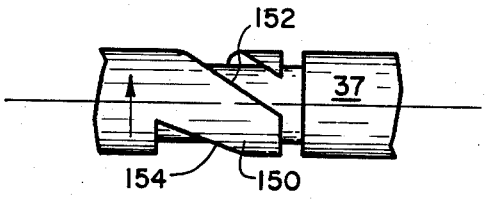
FIG. 5
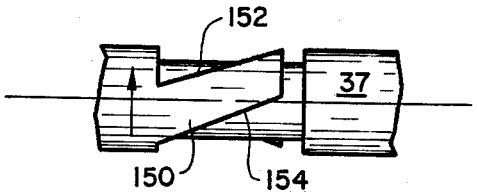
FIG. 6
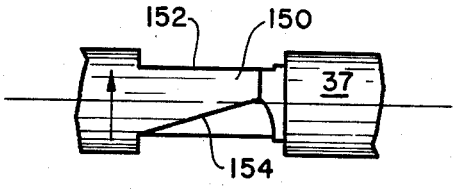
FIG. 7
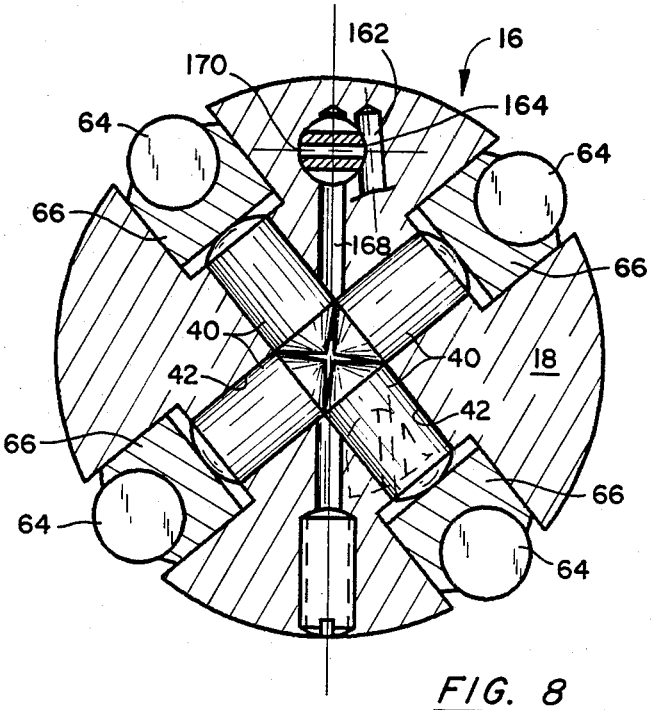
FIG. 8
FIG. 9
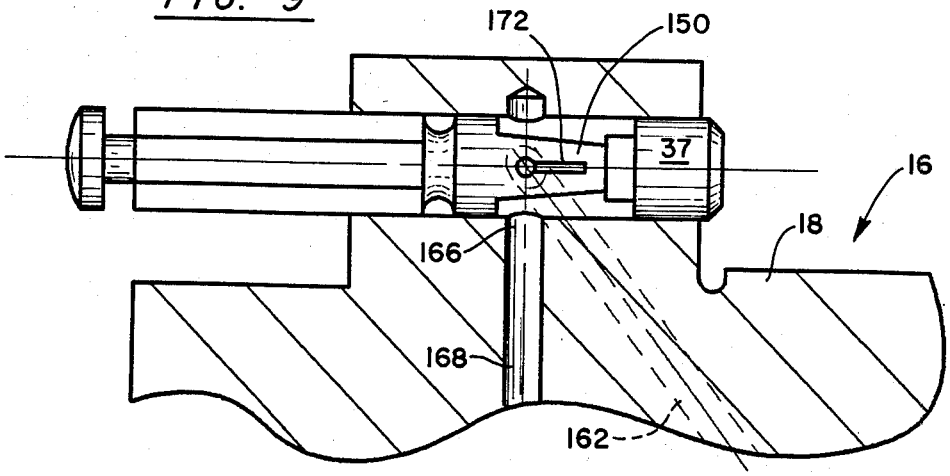

FUEL INJECTION PUMP WITH SPILL CONTROL MECHANISM

BACKGROUND AND SUMMARY OF THE INVENTION

The present invention relates generally to fuel injection pumps of the type having a rotary charge pump with one or more reciprocating pumping plungers for sequentially supplying measured charges of fuel under high pressure to an associated internal combustion engine for fuel injection and relates more particularly to a new and improved spill control mechanism for spill control of the high pressure fuel charges.

In a fuel injection pump of the type described, it may be desirable to control the size and/or timing of each high pressure fuel charge by a spill control system providing spill control of the beginning and/or end of the high pressure fuel injection event. For example, U.S. Pat. No. 4,376,432 of Charles W. Davis, dated Mar. 15, 1983, and entitled "Fuel Injection Pump With Spill Control Mechanism", discloses a spill control system providing spill control of the end of the fuel injection event.

In accordance with the present invention, several embodiments of a spill control mechanism are provided which employ one or more rotating fuel control valves for spill control of the high pressure fuel charges. The rotating fuel control valve(s) are mounted on the charge pump rotor and connected to the charge pump for spill control of the high pressure fuel charges. The high pressure fuel charge is precisely controlled with a high degree of repeatability and reliability over a long service free life.

A principal object of the present invention is to provide a new and improved spill control mechanism of the type operable for controlling the size and/or timing of the high pressure fuel charge by spill control of the beginning and/or end of the fuel injection event. In accordance with the present invention, the spill control mechanism is compact, is useful in rotary fuel injection pumps of the type described without substantial pump modification, can be economically manufactured and provides accurate spill control for repeatable delivery of precise high pressure fuel charges for fuel injection.

Another object of the present invention is to provide a new and improved spill control mechanism of the type described which provides precise control of the size of the injected fuel charges.

Another object of the present invention is to provide a new and improved spill control mechanism of the type described for establishing high pressure pilot fuel injection phase in advance of a main fuel injection phase.

Still another object of the present invention is to provide in a fuel injection pump of the type described, a new and improved spill control mechanism useful in fuel injection systems having very high fuel injection pressures of up to 12,000 psi or more.

A further object of the present invention is to provide a new and improved spill control mechanism of the type described having an operating mechanism for adjusting the quantity of an injected fuel charge in a precise and simple manner and for varying the fuel injection timing in accordance with a change in the engine load and/or engine speed.

Another object of the present invention is to provide a new and improved spill control mechanism of the type described for adjusting the spill timing at the beginning and end of the fuel injection event.

Another object of the present invention is to provide a new and improved spill control mechanism of the type described which can be readily adapted to be operated to control the quantity and/or timing of each high pressure fuel charge supplied by the pump, for example by mechanical, electrical, hydraulic and/or vacuum operated means driven by the fuel injection pump or the associated engine.

Other objects will be in part obvious and in part pointed out more in detail hereinafter.

BRIEF DESCRIPTION OF THE DRAWINGS

In the drawings

FIG. 2 is an enlarged partial longitudinal section view, partly broken away and partly in section, of the fuel pump, showing the fuel pump with a modified low pressure fuel system;

FIG. 3 is an enlarged partial transverse section view, partly in section, of the fuel pump;

FIGS. 4–7 are enlarged side views, partly broken away, of four embodiments of a fuel control valve of the spill control mechanism shown in FIGS. 1–3;

FIG. 8 is an enlarged transverse section view, partly in section, of a modified rotor the fuel pump;

FIG. 9 is an enlarged partial longitudinal section view, partly broken away and partly in section, of the modified rotor shown in FIG. 8;

DESCRIPTION OF THE PREFERRED EMBODIMENTS

Figure 1:
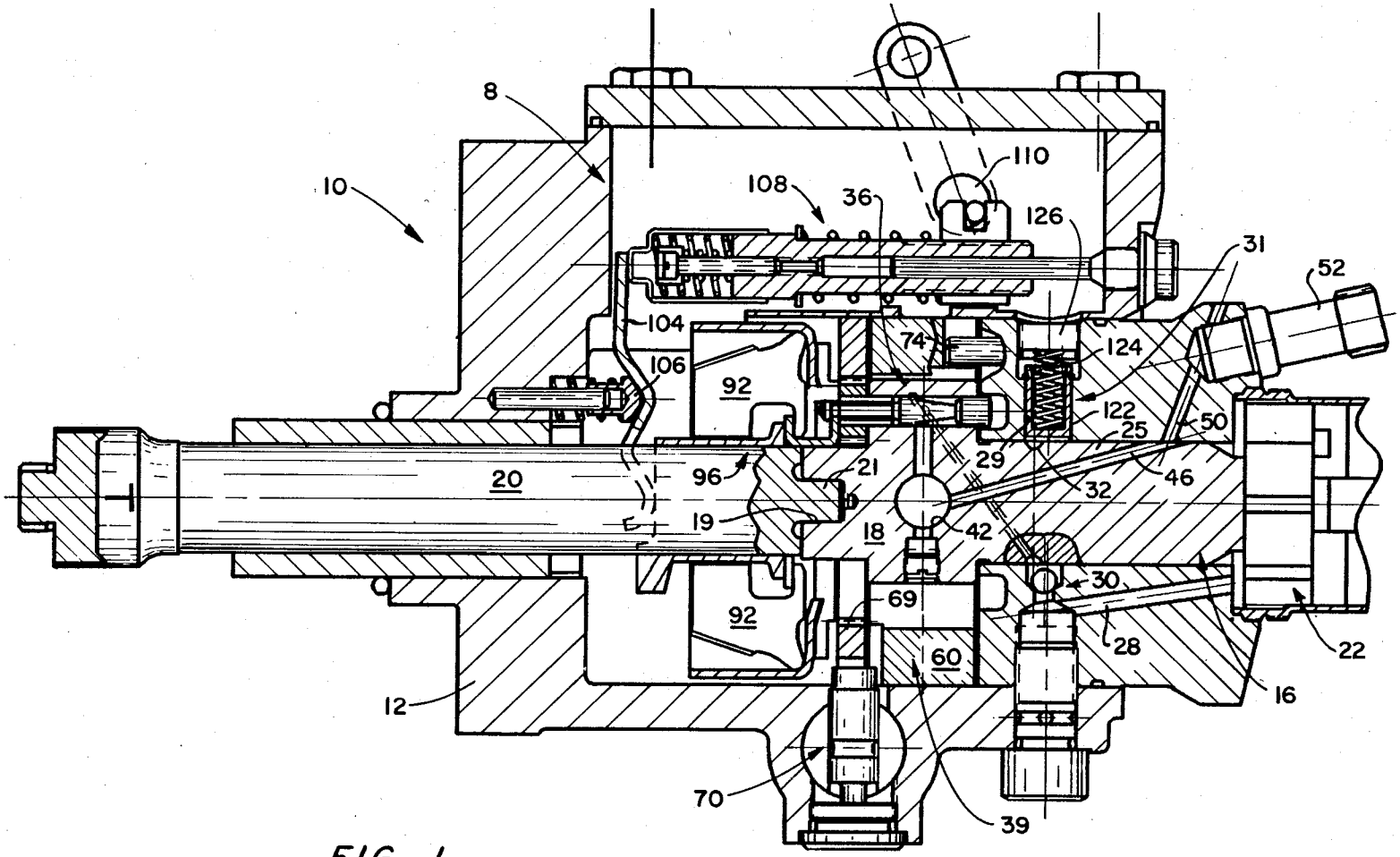
FIG. 1 is a longitudinal section view, partly broken away and partly in section, of a fuel injection pump incorporating a first embodiment of a spill control mechanism of the present invention.

Referring now to the drawings in detail wherein like numerals are used to designate the same or like functioning parts throughout, several different embodiments 8 of a spill control mechanism of the present invention are shown incorporated in a fuel injection pump 10 which is otherwise of generally conventional construction. The fuel injection pump 10 is operable for sequentially supplying measured pulses or charges of fuel under high pressure to the fuel injection nozzles (not shown) of an internal combustion engine (not shown). The pump 10 has a housing 12 and a rotor 16 with a rotor body 18 and a coaxial rotor drive shaft 20 journaled in the housing 12. The drive shaft 20 is adapted to be driven by the engine (not shown) conventionally at one half engine speed and is coupled or keyed to the rotor body 18 by a diametral slot 19 at the inner end of the rotor body 18 and a diametral tang or key 21 at the inner end of the shaft 20.

Figures 2, 3, 4:
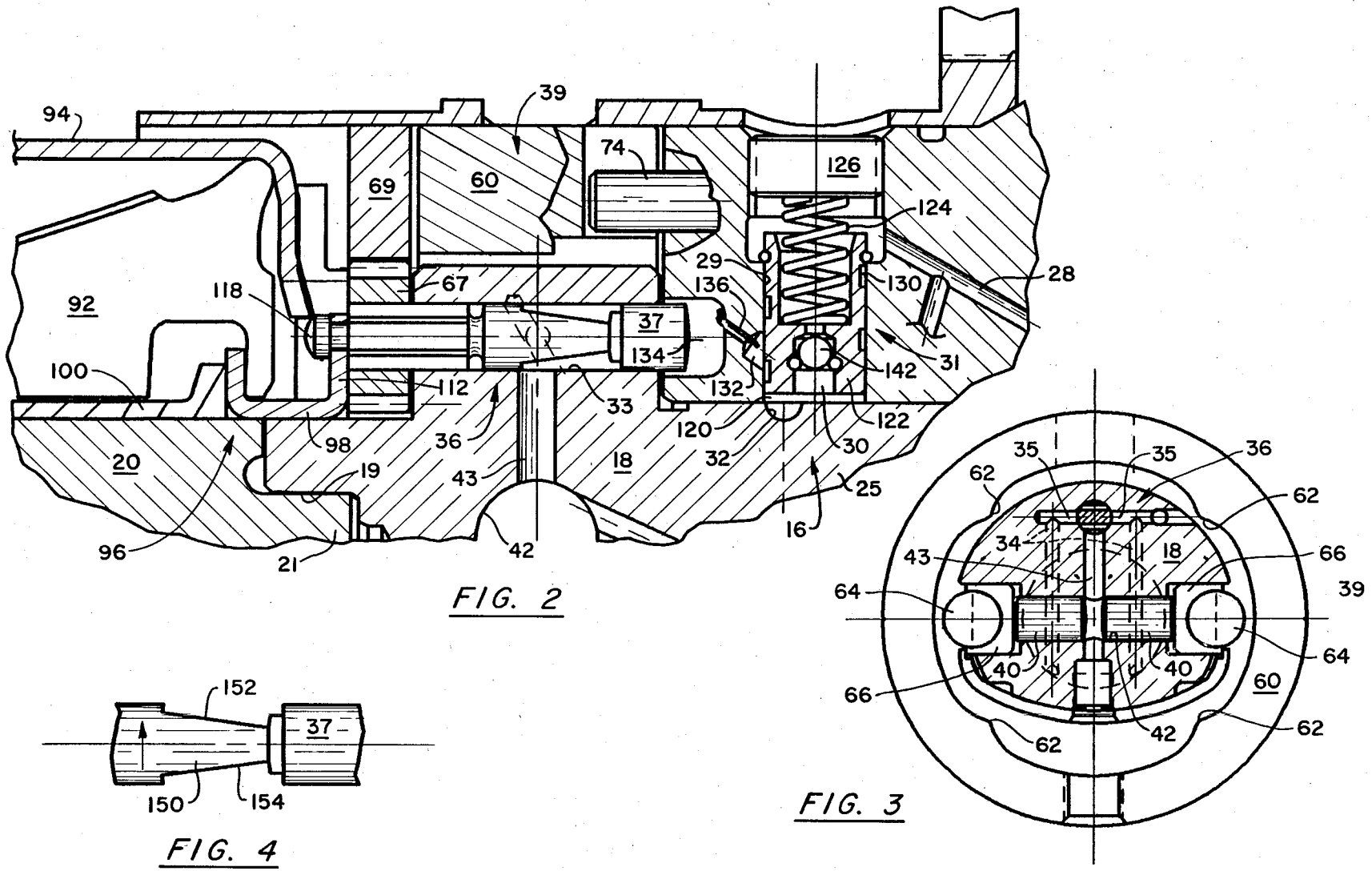

A vane-type fuel transfer pump 22 is provided at the outer end of the rotor body 18 for being driven by the rotor 16. The transfer pump 22 receives fuel from a fuel tank (not shown) and is connected to supply fuel at a transfer pressure to an external annulus or groove 32 in a stem 25 of the rotor body 16 via an inclined axial passage 28 and via either a combined one-way ball check valve 30 and accumulator 31 mounted in a radial bore 29 in the housing 12 (as shown in FIG. 2) or via only a one-way check valve 30 (as shown in FIG. 1). A rotary fuel control valve 36 has a cylindrical valve bore 33 within the rotor body 18, and the external groove 32 is connected to the valve bore 33 via a pair of separate internal passages 34 in the rotor body 18 which lead to a pair of diametrically opposed valve ports 35. The axis of the valve bore 33 is parallel to the axis of the rotor 16, and a rotary valve member 37 is mounted for both rotation and axial displacement within the valve bore 33.

A suitable pressure regulator (not shown) is provided for regulating the output or transfer pressur of the transfer pump 22. In a conventional manner, the pressure regulator provides a speed correlated transfer pressure which increases with pump speed for operating certain hydraulically actuated mechanisms of the fuel pump. Also, the housing preferably has a suitable pressure relief valve (not shown) to maintain the fuel pressure within the housing cavity at a constant relatively low level of for example 10 psi and to return excess fuel to the fuel tank.

A high pressure rotary charge pum 39 of the fuel injection pump 10 is shown in FIG. 3 having one pair of diametrically opposed coaxial pumping plungers 40 mounted for reciprocation within a diametral bore 42 in the rotor body 18. The charge pump 39 receives fuel from the transfer pump 22 via the fuel control valve 36 and via a radial bore 43 in the rotor body 18 which connects the valve bore 33 to the center of the pumping plunger bore 42.

A fuel charge at high pressure is delivered by the charge pump 39 via an inclined axial outlet bore or distributor passage 46 (FIG. 1) in the rotor body 18. The distributor passage 46 extends from the center of the pumping plunger bore 42 and registers sequentially with a plurality of housing outlet passages 50 (only one of which is shown in FIG. 1) equiangularly spaced around the periphery of the rotor 16. The outlet passages 50 are angularly spaced to provide sequential registration with the distributor passage 46 during the inward compression or delivery stroke of the plungers 40. A suitable delivery valve (not shown) is mounted downstream of each outlet passage fitting 52 to achieve a sharp cut-off of fuel to the respective fuel injection nozzle and to maintain a high residual pressure in the downstream fuel delivery line (not shown) leading to the nozzle.

An annular cam ring 60 having a plurality of equiangularly spaced pairs of diametrically opposed cam lobes 62 is provided for simultaneously actuating the charge pump plungers 40 inwardly for delivering high pressure charges of fuel for fuel injection as the rotor 16 rotates. A roller 64 and roller shoe 66 are mounted on the rotor body 18 in radial alignment with each plunger 40 for actuating the plunger inwardly. Radial slots are provided in the rotor body 18 at the outer ends of the diametral plunger bore 42 for receiving the roller shoes 66.

A drive or satellite gear 67 is mounted on the rotary valve member 37 for engagement with an internal ring gear 69 mounted on the left side of the annular cam ring 60 a viewed in FIGS. 1 and 2. The satellite gear 67 is keyed to the rotary valve member 37 by means of a hexagonal opening in the gear and a conforming transverse hexagonal section of the valve member 37 which permits the valve member 37 to be axially shifted within the satellite gear 67. The ring gear 69 is angularly adjustable but does not rotate with the rotor 16 and such that the valve member 37 is rotated within its mounting bore 33 in unison with the rotor 16 and in synchronism with the reciprocable movement of the pumping plungers 40. The gear ratio provided by the valve and ring gears 67, 69 is selected to provide for example exactly three or four full revolutions of the valve member 37 within its mounting bore 33 for each full revolution of the rotor 16 depending on the number and therefore angular spacing of the distributor outlet passages 50 and thus the design of the associated engine. Although the axis of the rotary control valve 36 is preferably parallel to the rotor axis as shown and described, if desired, the valve axis may be at an acute angle to the rotor axis or perpendicular to the rotor axis, in which event the valve drive gearing would be modified accordingly.

Figure 11:
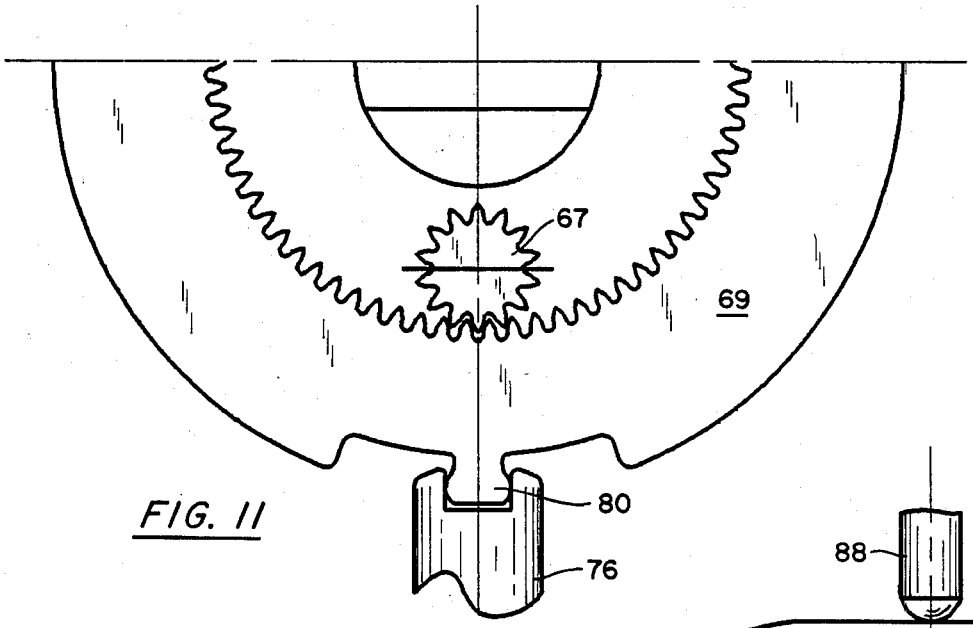
FIG. 11 is an enlarged partial transverse section view, partly broken away, showing timing adjustment device of the spill control mechanism.
Figure 12:
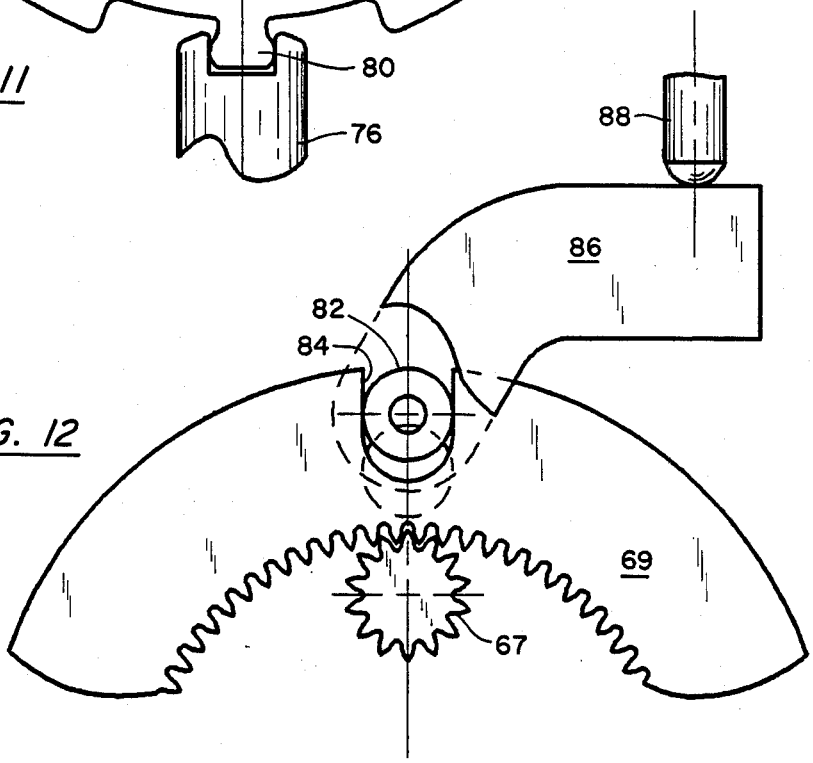
FIG. 12 is an enlarged partial transverse section view, partly broken away, a modified embodiment of the timing adjustment device of the spill control mechanism.

For adjusting the spill timing of the fuel injection event in correlation with engine speed, either the annular cam ring 60 and gear ring 69 are angularly adjusted together by a suitable hydraulic timing actuator 70 or only the annular gear ring 69 is angularly adjusted by a suitable timing actuator 70 as shown in FIG. 1. In the former case, the timing actuator 70 for example may be identical to that shown in U.S. Pat. No. 3,331,327 of V. D. Roosa dated July 18, 1967 and entitled "Fuel Pump", and the gear ring 69 is connected to the cam ring 60 by suitable drive pins to be angularly adjusted with the cam ring 60, or the gear ring 69 is mounted to be angularly adjusted with the cam ring 60 and also relative to the cam ring as shown in FIG. 12. In the embodiment shown in FIG. 1, the cam ring 60 is fixed to the housing 12 by suitable locating pins 74 and for example as shown in FIG. 11 the gear ring 69 is connected to be angularly adjusted by the timing actuator 70 via an upstanding transverse pin 76 of the actuator 70. For that purpose, the pin 76 has a slot receiving a cylindrical projection 80 of the gear ring 69. Thus, in the embodiment shown in FIG. 1, the angular reaction force on the cam ring 60 resulting from the inward actuation of the pumping plungers 40 is transmitted directly to the housing and the hydraulic actuator 70 is preferably economically designed to provide only the relatively light force required for angularly adjusting the gear ring 69. Also, to minimize the force required for rotating and axially shifting the valve member 37 and to reduce valve wear and improve valve operation, the valve member 37 is hydraulically balanced within its mounting bore 33. For that purpose, the two diametrically opposed valve ports 35 are provided for balancing the hydraulic side forces on the valve member 37.

In the embodiment shown in FIG. 12, the gear ring 69 is mounted to be angularly adjusted relative to the cam ring 60 to provide a secondary timing control in addition to the primary timing control provided by the timing actuator 70. For that purpose, an eccentric or cam 82 is mounted on the cam ring 60 for receipt within a radial slot 84 in the gear ring 69. Rotation of the eccentric 82 by its operating arm 86 angularly adjusts the gear ring 69 relative to the cam ring 60 to provide secondary timing adjustment. The eccentric operating arm 86 is pivoted for example by a load responsive actuator 88 like that used for pivoting the spill collar operating arm in U.S. Pat. No. 4,376,432.

A plurality of governor weights 92 (only two of which are shown in FIG. 1) are equiangularly spaced about the drive shaft 20 and are mounted in a suitable cage 94 attached to the rotor 16 to provide a variable axial bias on an axially shiftable collar 96. The collar 96 comprises a valve operating ring 98 which rotates with the rotor 16 and a non-rotatable sleeve 100 engaging the ring 98. The sleeve 100 engages a pivotal lever 104 to urge the lever 104 in the clockwise direction as viewed in FIG. 1 about its support pivot 106. The leve 104 is biased in the opposite pivotal direction by a governor spring assembly 108, which for example is identical to that disclosed in U.S. Pat. No. 4,142,499 of D. E. Salzgeber, dated Mar. 6, 1979 and entitled "Temperature Compensated Fuel Injection Pump". The opposing bias on the lever 104 provided by the governor spring assembly 108 is established by the angular position of a throttle operated shaft 110 (FIG. 1), and in a conventional manner the governor spring assembly 108 provides for both idle or minimum speed governing and maximum speed governing.

The valve operating ring 98 has a tang formed to provide an axially offset, radial projection or yoke 112 having a radial slot for receiving a reduced intermediate section of the rotary valve member 37. The valve member 37 is thereby connected to be axially shifted with the collar 96. A suitable circular compression spring is preferably mounted between the yoke 112 and an outer head 118 of the valve member 37 to eliminate any backlash between those parts.

As hereinafter described, the quantity or size of the high pressure charge of fuel delivered by the charge pump 39 in a single inward pumping stroke of the pumping plungers 40 is controlled by varying the axial position of the rotary valve member 37. The opposing forces of the governor spring assembly 108 and governor fly weights 92 control the axial position of the valve member 37 to govern the engine at preestablished idle and maximum speeds. The throttle operated shaft 110 axially positions the valve member 37 throughout the full intermediate speed range of the engine.

The present invention can also be used with a governor spring assembly of the type used for full speed range governing and wherein the throttle operated shaft 110 is used to set the engine speed and the governor mechanism governs the fuel injection pum to maintain the engine speed at that speed setting. For example, a full speed range governor spring assembly may be used like that disclosed in U.S. Pat. No. 2,865,347 of V. D. Roosa, dated Dec. 23, 1958 and entitled "Control Means For A Fuel Pump Valve".

The fuel control valve 36 functions as both an inlet valve and a spill valve. In its function as an inlet valve, it provides for connecting the fuel supply ports 35 to the plunger bore 42 during the outward or intake stroke of the plungers 40. Fuel at transfer pump pressure is thereby supplied to the charge pump 39 preferably without restriction or inlet metering. The centrifugal force of the plungers 40 and the unrestricted fuel supply provides for fully charging the charge pump without cavitation and with the same full charge during each outward intake stroke of the pumping plungers 40.

The fuel control valve 36 provides spill control or spill timing at both the beginning and end of the inward or pumping stroke of the pumping plungers 40. During both spill intervals, the spilled fuel is returned to an accumulator chamber 120 at the inner end of the radial bore 29 in the housing 12. An accumulator piston 122 is mounted in the radial bore 29 and is biased to its inner limit position shown in FIG. 1 by a compression spring 124 having a preload established by an externally threaded, adjustable spring seat 126. A snap ring is mounted within an external annulus in the accumulator piston 122 to establish the inner limit position of the piston. The outer generally cylindrical surface of the accumulator piston is provided with a helical groove 130 extending from the outer end of the piston 122 to an intermediate discharge port 132 connected to the pump housing cavity via a circular groove or annulus 134 in the housing 12 aligned with the valve member 37. The accumulator piston 122 is thereby cooled by a continuous flow of fuel helically around the accumulator piston. A suitable flow restrictor 136 is placed in the outlet passage connecting the intermediate outlet port 132 to the housing annulus 134 to regulate the rate of flow of fuel used for cooling.

In the embodiment shown in FIG. 2, the accumulator piston 122 has an inner axial bore, an outer axial bore providing a spring chamber for the accumulator spring 124 and an intermediate section with a central valve opening for the ball check valve 30. A snap ring is mounted within the inner axial bore to retain the valve ball 142 adjacent its conical valve seat for quickly closing the check valve 30 when fuel is returned to the accumulator chamber 120.

The fuel accumulated during each inward or pumping stroke of the plungers 40 is redelivered to the charge pump 39 during the succeeding outward or intake stroke of the pumping plungers 40. The accumulator spring 124 is preferably preloaded to establish an accumulator pressure of for example approximately 200–300 psi which is significantly above the 40–100 psi transfer pressure range and significantly below the fuel injection pressure of up to 12,000 psi or more. Thus, during each intake stroke of the pumping plungers 40, the high accumulator pressure accelerates the fuel charging step to ensure complete fuel charging even at high pump speed.

Referring to FIGS. 4–7, the valve member 37 has a pair of identical diametrically opposed lands 150 for simultaneously opening and closing the two diametrically opposed valve ports 35. The radial connecting bore 43 preferably has a valve port which has a circumferential width greater than the maximum width of the lands 150 so that fuel is supplied without interruption to the charge pump 39 during the outward or intake stroke of the plungers 40 while the valve ports 35 are open. The two diametrically opposed lands 150 have diametrically opposed leading edges 152 for simultaneously closing the valve ports 35 and diametrically opposed trailing edges 154 for simultaneously opening the valve ports 35. The circumferential width of the valve lands 150 varies along the axis of the valve member 37 and so that the effective inward pumping stroke of the pumping plungers 40 is dependent upon the axial position of the valve member 37. In the embodiment shown in FIG. 4, the leading and trailing edges 152, 154 taper toward each other in the retard and advance angular directions respectively. Alternatively, the leading edge 152 may be parallel to the axis of the valve member 37 as shown in FIG. 7, or (a) inclined in the advance direction as shown in FIG. 6 (to advance the fuel injection timing with load) or (b) inclined in the retard direction as shown in FIG. 5 (to retard the fuel injection timing with load). Likewise, the trailing edge 154 could be (a) inclined in the retard direction as shown in FIG. 5 or (b) inclined in the advance direction a shown in FIG. 6 as may be found desirable for any particular application. In any event, the leading and trailing edges 152, 154 are related to provide a land 150 of decreasing circumferential width to decrease the angular interval of fuel injection and the size of the injected fuel charge as the valve member 37 is axially shifted to the left as viewed in FIG. 1. Also, the land width can be established to provide excess fuel for starting when the valve member 37 is at its fully retracted engine cranking position.

Thus it can be seen that the size of the injected fuel charge and the timing of the beginning and end of the fuel injection event are spill controlled in accordance with the axial position of the valve member 37. In addition, the fuel injection timing is controlled by angular adjustment of the gear ring. Where the gear ring 69 and cam ring 60 are axially adjusted together, the same segments of the cam lobes 62 are employed for the fuel injection event throughout the full load range of the engine and the rate of injection is established by the slope of those cam segments. If the gear ring 69 is angularly adjustable relative to the cam ring 60, then the effective cam lobe segment is shifted as the gear ring 69 is angularly shifted relative to the cam ring 60. In either event, the shape of the cam lobes is optimized for the described spill control and the cam lobe shape and timing adjustment range are preferably related so that during normal pump operation, the fuel injection event is spill terminated before the pumping plunger actuating rollers 64 reach the convex or nose segment of the cam lobe 62 where the contact pressure on the cam lobe 62 would otherwise be the greatest. As a result, a fuel injection pressure of up to 12,000 psi or more can be delivered by the pump without creating an unacceptably high contact pressure on the cam lobes 62. If desired, over the nose fuel injection can be employed during engine cranking and/or low engine speed (when the reaction force on the cam lobe 62 is relatively low due to the low pump speed) to provide excess fuel for starting and/or to lengthen the fuel injection interval to produce quiet combustion.

The valve ports 35 are closed twice during each revolution of the valve member 37. If the valve gearing provides for rotating the valve member 37 exactly four full revolutions for each revolution of the rotor 16, then the fuel control valve 36 is capable of providing a fuel injection event every 45 degrees of rotation of the rotor 16. Thus, the same gearing can be employed to provide either two, four or eight fuel injection events during one full revolution of the rotor 16 (and therefore two revolutions of the associated engine) depending on the number of pairs of diametrically opposed cam lobes provided on the cam ring 60. Similarly, gearing designed for rotating the valve member 37 exactly three full revolutions for each full revolution of the rotor 16 can be used, depending on the number of pairs of diametrically opposed cam lobes 62 provided on the cam ring 60, to provide either three or six fuel injection events during one full revolution of the rotor 16. Also, gearing providing exactly two and one-half revolutions of the valve member 37 for every full revolution of the rotor 16 can be used to provide five fuel injection events per pump revolution (i.e. for a five cylinder engine and for example using a pumping plunger and plunger operating cam arrangement as disclosed in U.S. Pat. No. 4,255,097 of Charles W. Davis et al, dated Mar. 10, 1981 and entitled "Fuel Injection Pump"). Thus, the same basic pump design can be generally universally employed with minimum customization of parts for each engine application.

In view of the substantially higher rate of rotation of the valve member 37 than the rotor 16, the rotary valve 36 is quickly closed and opened to provide very precise spill control of the beginning and end of the fuel injection event. Accordingly, the rotating valve member 37 reduces the undesirable fuel restriction interval during port closure and leakage interval just before the port opens. In addition, the relatively small "dead" volume within the rotor 16 minimizes the effect of fuel compression on the size and timing of the fuel injection event. Further, the valve member 37 is hydraulically balanced throughout its entire operating cycle to maximize valve reliability and minimize valve wear and the forces required for rotating and axially shifting the valve member 37. Moreover, since the periphery of the rotor body stem 25 does not provide spill valving as in conventional spill control systems exemplified by the system disclosed in U.S. Pat. No. 4,376,432, the diameter of the rotor body stem 25 and the cost of manufacture of the related pump structure can be reduced.

Figure 10:
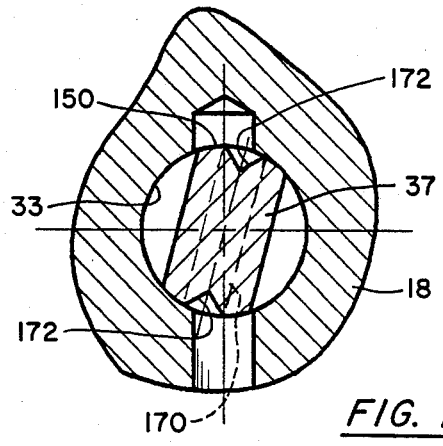
FIG. 10 is an enlarged partial transverse section view, partly broken away and partly in section, of the modified rotor shown in FIGS. 8 and 9.

A modified rotor shown in FIGS. 8–10 has two intersecting diametral bores 42 and four equiangularly spaced pumping plungers 40. A suitable bore 162 is provided in the rotor body to connect the external groove 32 to the valve bore 33. That connecting bore 162 is offset from the valve bore 33 to provide a connecting port 164 having a circumferential dimension greater than the maximum circumferential width of the valving member lands 150 to preclude interruption of fuel flow to the charge pump during the outward or intake stroke of the pumping plungers 40. The valve member 37 opens and closes a valve port 166 of a bore 168 connecting the valve bore 33 to the central intersection of the two pumping plunger bores 42. The "dead" volume of the high pressure fuel cavity of the rotor is thereby reduced. The connecting bore 168 crosses the valve bore 33 and the valve member 37 is formed with a diametral bore 170 and connecting axial channels or grooves 172 in its two diametrically opposed lands 150 to balance the hydraulic side forces on the valve member 37 without effecting the valve spill control. The four plunger rotor is particularly useful with relatively high fuel injection pressure systems to reduce the diameter of the pumping plungers 40 and therefore the force on the cam lobes 62 required for actuating the plungers inwardly at the high fuel injection pressure.

Figure 13:
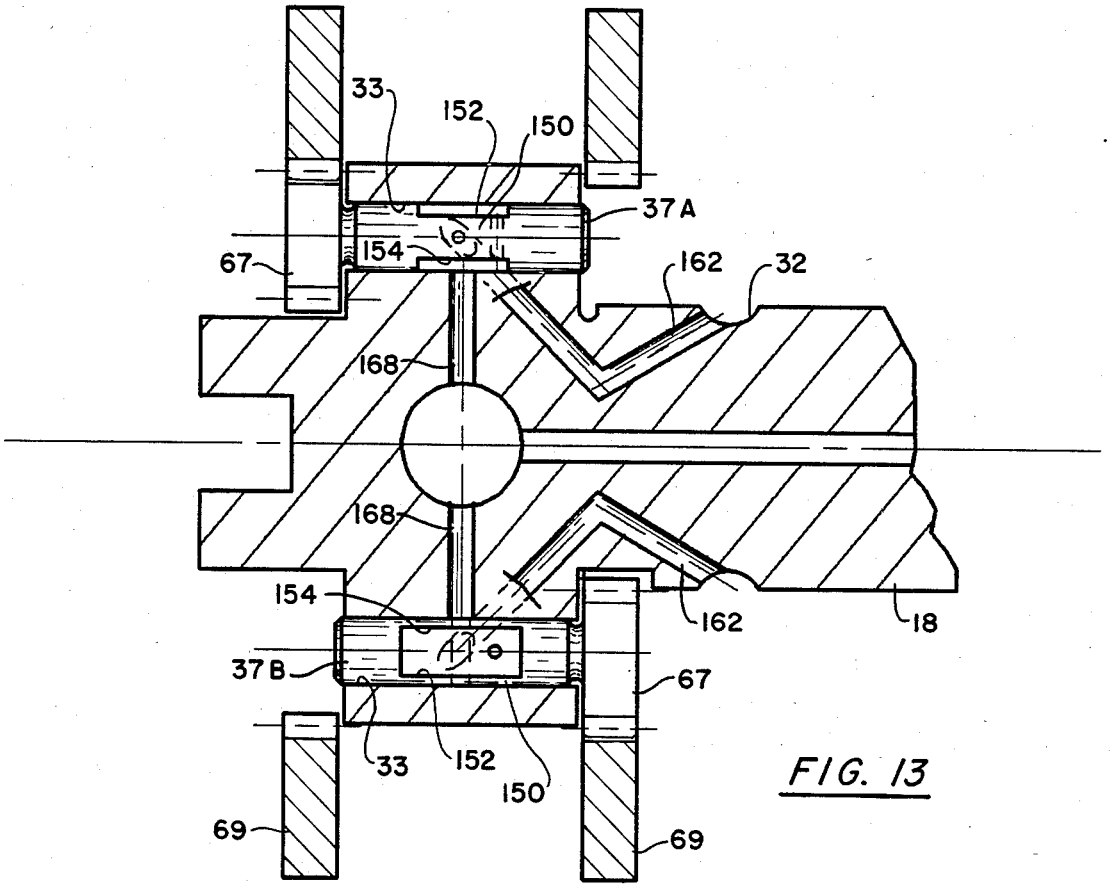
FIG. 13 is an enlarged partial longitudinal section view, partly broken away and partly in section, showing another embodiment of a spill control mechanism.

Another modified rotor shown in FIG. 13 has two axial valve bores 33 and two corresponding preferably identical valve members 37A, 37B connected in parallel between the external groove 32 and two separate radial bores 168 leading to the pumping plunger bore(s). One of the valve members 37A is used for beginning of injection spill control and the other valve member 37B is used for end of injection spill control. The two valve members 37A, 37B are rotated by two separate ring gears 69 to provide separate and independent angular adjustment of the two valve members and therefore separate and independent spill control of the beginning and end of the fuel injection event. Axial adjustment of the valve members and use of a governor or other mechanism for that purpose are therefore unnecessary. Also, the leading and trailing edges 152, 154 of each valve member 37A, 37B preferably are parallel to the axis of the valve member. However, if desired, one or both of the valve members could be axially adjusted as previously described and the diametrically opposed lands 150 of each axially adjusted valve member could be formed accordingly to provide the desired spill control. The two ring gears 69 are shown mounted at opposite axial ends of the control valves but may be mounted at the same axial end of the control valves if desired. The two gear rings 69 are independently angularly adjusted by separate linear actuators, as described with respect to the embodiments of FIGS. 1 and 11. For example, by linear actuators 70.

Figure 14:
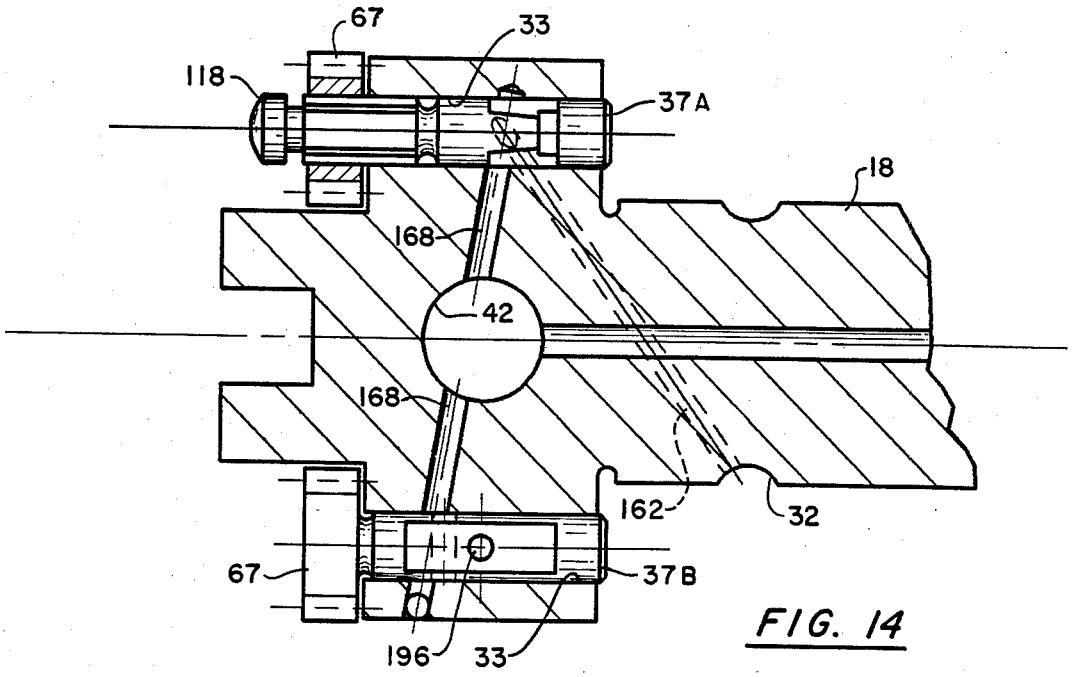
FIGS. 14–16 are enlarged partial longitudinal section views, partly broken away and partly in section, showing three additional embodiments of the spill control mechanism of the present invention.
Figure 15:
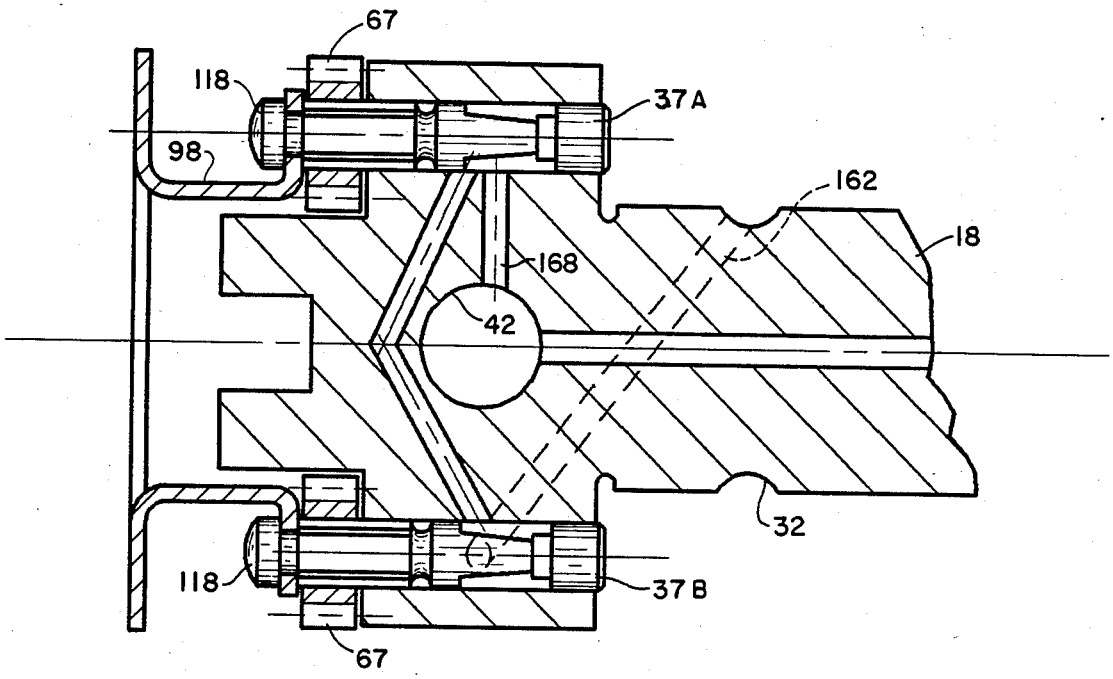
Figure 16:
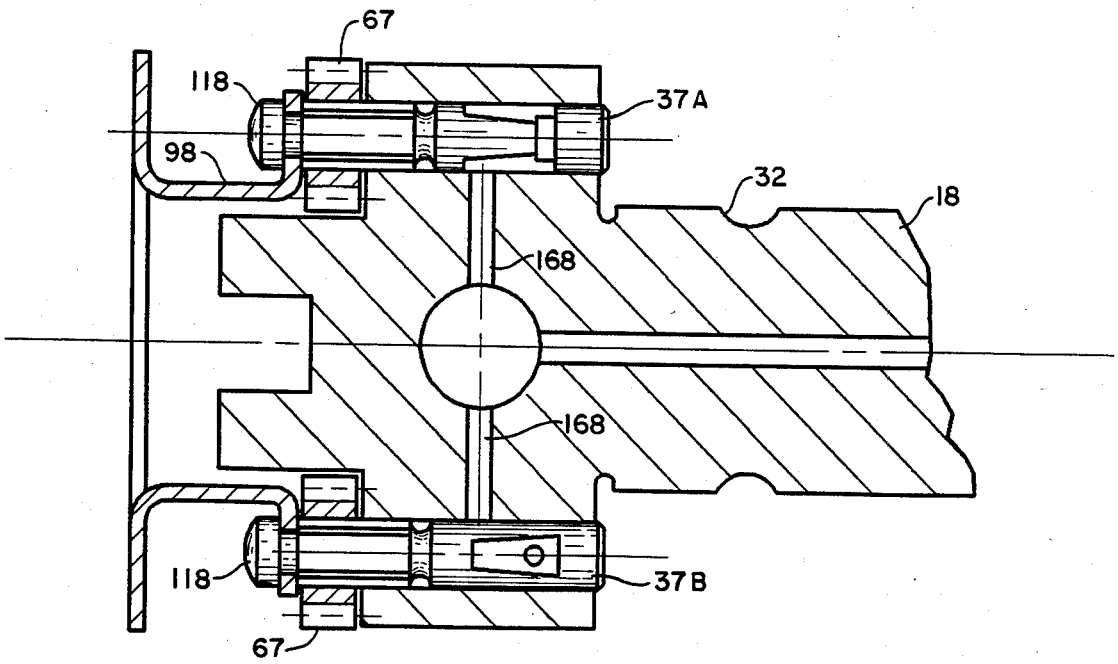

Three additional modified rotors shown in FIGS. 14–16 employ two fuel control valves 37A, 37B in the manner of the modified rotor 180 shown in FIG. 13 but for a different purpose. In FIGS. 14–16, the two valve members 37A, 37B provide for a two phase fuel injection event having a first high pressure pilot injection phase and an immediately succeeding main fuel injection phase. In FIG. 14, a primary valve member 37A functions in the same manner as the valve member 37 employed in the embodiment shown in FIGS. 1–3. A secondary or pilot fuel valve member 37B provides for momentarily relieving the high fuel injection pressure to provide separate pilot and main fuel injection phases. Both valve members 37A, 37B are rotated in synchronism by the same gear ring 69. Also, either both valve members, or as shown only the primary valve member 37A, is axially adjusted for example as in the embodiment of FIG. 1. The high pressure is momentarily relieved, for example from 12,000 psi to 5,000 psi by momentarily connecting the charge pump 39 to an additional "dead" volume formed by flats in the pilot control valve 37B. The pilot valve member 37B has a pair of intersecting diametral bores 196 for momentarily connecting the charge pump to that additional "dead" volume. The diametral bore 196 slightly overlaps the respective connecting bore 168 to provide a very short interval during which the high pressure is relieved. During the outward or inlet stroke of the pumping plungers 40, the additional "dead" volume is connected to the inlet or transfer pressure to relieve the "dead" volume pressure for the succeeding fuel injection event. The size of the "dead" volume is established to achieve the desired momentary pressure reduction by compression of the fuel in the additional "dead" volume and if needed additional "dead" volume may be provided in the rotor body 18 in communication with the pilot valve bore 33. Alternatively, a suitable small volume spring biased accumulator piston (not shown) may be mounted in the rotor body 18 in communication with the pilot valve bore 33 to momentarily reduce the fuel injection pressure as desired.

In the rotor embodiment shown in FIG. 15, the two fuel control valves 37A, 37B are connected in series for series spill control. The primary spill control valve 37A provides spill control of the beginning and end of the main fuel injection phase and the secondary or pilot fuel control valve 37B provides spill control of the beginning and end of the pilot injection phase. Both fuel control valves 37A, 37B are axially adjusted for example as in the embodiment of FIG. 1.

Figure 17:
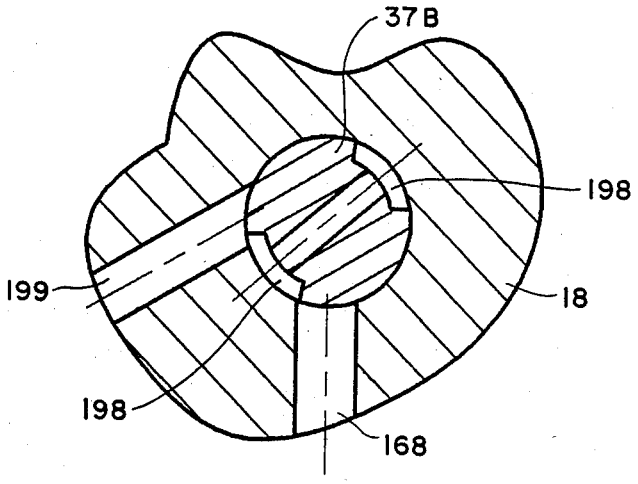
FIG. 17 is an enlarged partial transverse section view, partly broken away and partly in section, of a secondary fuel control valve of the spill control mechanism of FIG. 16.

The rotor embodiment shown in FIG. 16 is similar to that shown in FIG. 15 except that in FIG. 16 the primary and secondary fuel control valves 37A, 37B are mounted in parallel as in FIG. 13 rather than in series as in FIG. 15. The primary valve member 37A provides spill control of the beginning and end of the entire fuel injection event. The secondary or pilot valve member 37B provides for momentarily relieving the high pressure for separating the fuel injection event into separate pilot and main fuel injection phases. For that purpose, the pilot valve member 37B momentarily connects the charge pump to the housing cavity via one of two diametrically opposed peripheral grooves 198 in the valve member 37B and via a bore 199 in the rotor body 18 as shown in FIG. 17.

Figure 18:
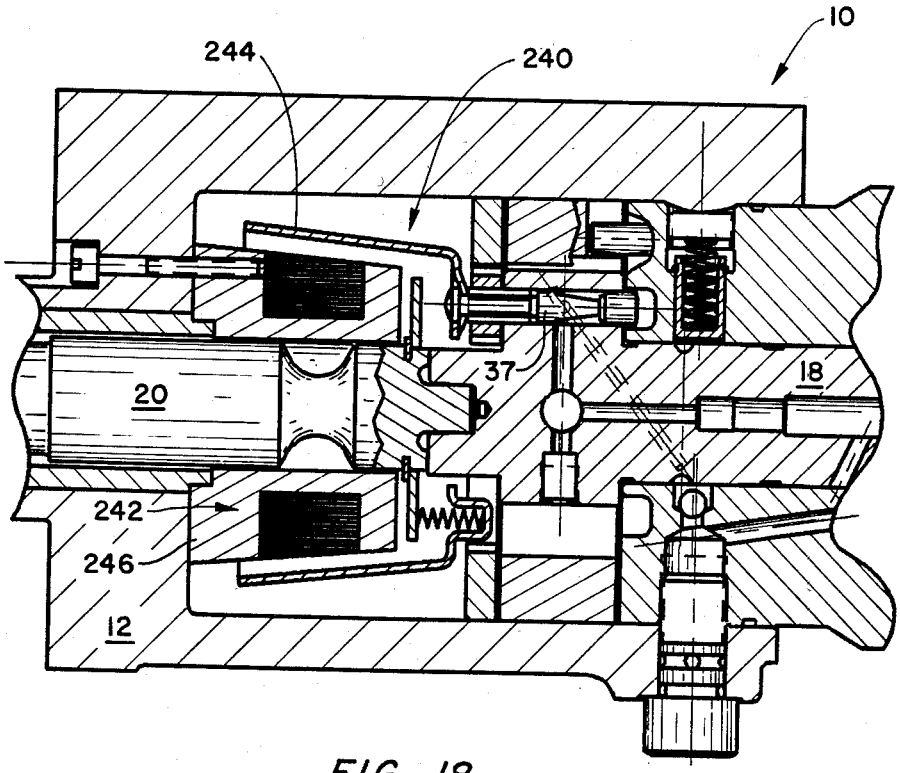
FIGS. 18 and 19 are enlarged partial longitudinal section views, partly broken away and partly in section, showing further embodiments of the spill control mechanism of the present invention having solenoid and stepper motor operating systems respectively.
Figure 19:
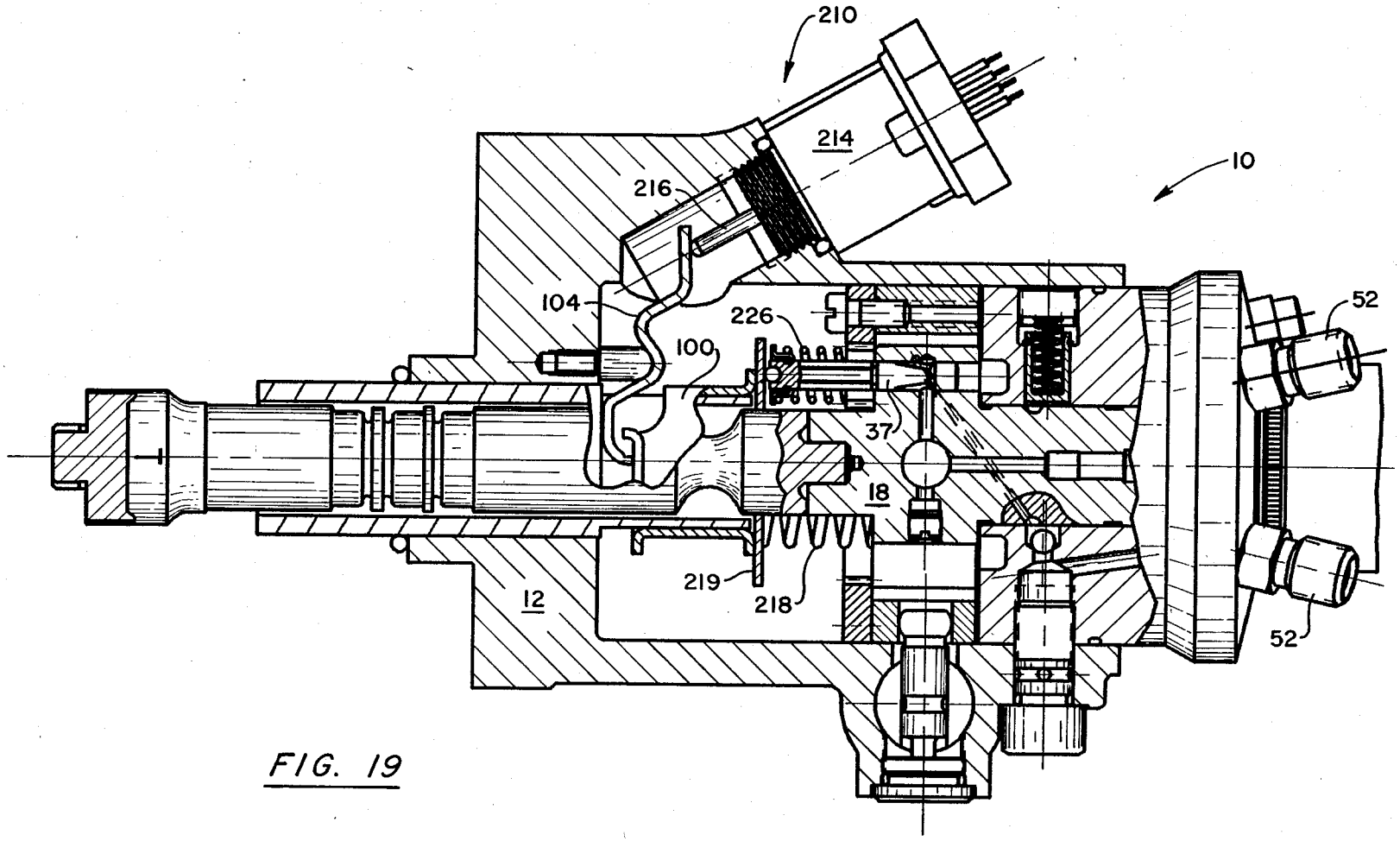

FIGS. 18 and 19 show two alternative mechanisms 210, 240 for axially positioning the fuel control valve member(s) 37. In FIG. 19 a bidirectional rotary stepper motor 214 having a linear actuating pin 216 is provided for axially positioning the valve member(s) via the lever 104 and sleeve 100. The sleeve 100 is biased in the opposite axial direction by a compression spring 218 mounted between the rotor body 18 and a thrust plate 219. The valve member(s) 37 are axially positioned by the thrust plate 219. For that purpose, a ball bearing 222 is mounted within a pocket in the outer end of the valve member 37 and the valve member 37 is biased outwardly by a compression spring 226 to urge the ball bearing into engagement with the thrust plate 219. A linear fuel quantity feedback sensor (not shown) is mounted within the pump housing 12 with its linear plunger engaging the thrust plate 219. The sensor supplies a signal to an electronic control unit (not shown) to complete a fuel quantity control loop.

In FIG. 18 the valve member(s) 37 are positioned by a solenoid 242 having an annular armature 244 coaxially mounted for rotation with the rotor 18 and connected to the valve member(s) 37. The armature 244 is axially shiftable by a fixed annular electromagnet 246 which encircles the rotor drive shaft 20. Therefore, the axial position of each valve member 37 is dependent upon the voltage applied to the electromagnet 246.

The several described embodiments of the spill control mechanism of the present invention can be used with a min/max or full speed range governor or with an electrical control as described. Also, it will be apparent that the different features illustrated in connection with the several embodiments of the invention disclosed herein may be utilized and incorporated in other embodiments as desired. As will be apparent to persons skilled in the art, various modifications, adaptations and variations of the foregoing specific disclosures can be made without departing from the teachings of the present invention.

I claim:

1. In a rotary fuel injection pump for an internal combustion engine, having a housing, a rotor rotatable in the housing, a charge pump having a plurality of radially extending plunger bores in the rotor and a plunger pump for each plunger bore having a pumping plunger reciprocable in the bore, the pumping plungers having outward fuel intake strokes and inward fuel delivery strokes for supplying high pressure charges of fuel for fuel injection, and a cam ring surrounding the rotor and engageable with the plunger pumps to reciprocate the plungers as the rotor rotates, and a spill control mechanism having spill valve means connected to the charge pump for spill control of the said high pressure charges of fuel, the improvement wherein the spill valve means comprises at least one rotary spill valve having a valve bore in the rotor connected to the charge pump and a rotary spill valve member rotatably mounted within the valve bore, and wherein the spill control mechanism comprises first means for rotating each rotary spill valve member in unison with the rotor and in synchronism with the reciprocable movement of the pumping plungers for spill control of the said high pressure charges of fuel.

2. A fuel injection pump according to claim 1 wherein said first means is adjustable for adjusting the relative angular positions of the rotary spill valve member of at least said one rotary spill valve and the rotor as they rotate in unison.

3. A fuel injection pump according to claim 2 wherein the relative angular positions of the rotary spill valve member of at least said one rotary spill valve and the rotor are adjusted to adjust the fuel injection timing.

4. A fuel injection pump according to claim 1 having two of said rotary spill valves and wherein said first means is adjustable for adjusting the relative angular positions of each rotary spill valve member and the rotor as they rotate in unison.

5. A fuel injection pump according to claim 1 further comprising fuel supply means for supplying fuel to said one rotary spill valve, wherein the rotary spill valve member of said one rotary spill valve serves to supply fuel to the charge pump during the outward fuel intake strokes of the pumping plungers and to spill fuel from the charge pump during part of the inward fuel delivery strokes of the pumping plungers.

6. A fuel injection pump according to claim 1 wherein said first means comprises gear ring means surrounding the rotor and gear means on each rotary spill valve member engageable with the gear ring means to rotate the valve member within its valve bore in unison with the rotor.

7. A fuel injection pump according to claim 6 wherein said first means comprises angular adjustment means for angularly adjusting the gear ring means.

8. A fuel injection pump according to claim 1 wherein the rotary spill valve member of at least said one rotary spill valve is mounted for axial adjustment within its valve bore for adjusting its spill control of the said high pressure charges of fuel and wherein the spill control mechanism comprises second means for axially adjusting each such axially adjustable valve member.

9. A fuel injection pump according to claim 8 wherein said second means comprises a flyweight speed governor for axially adjusting each such axially adjustable valve member.

10. A fuel injection pump according to claim 8 wherein said second means comprises an adjustment ring surrounding the rotor generally coaxial and rotatable therewith, the adjustment ring being connected to each such axially adjustable valve member for axial adjustment thereof by relative axial adjustment of the adjustment ring and rotor, and axial adjustment means for relative axial adjustment of the adjustment ring and rotor.

11. A fuel injection pump according to claim 10 wherein said axial adjustment means comprises a stepping motor connected to the adjustment ring for axial adjustment thereof relative to the rotor.

12. A fuel injection pump according to claim 8 wherein said second means comprises an electrical solenoid having a fixed annular coil generally coaxial with the rotor and a rotating annular armature generally coaxial with the rotor and connected to each such axially adjustable valve member, the armature being axially adjustable relative to the rotor in accordance with the magnetic force established by the solenoid coil.

13. A fuel injection pump according to claim 1, 2 or 8 wherein the spill valve means comprises two of said rotary spill valves connected in parallel.

14. A fuel injection pump according to claim 1, 2 or 8 wherein the spill valve mean comprises two of said rotary spill valves connected in series.

15. A fuel injection pump according to claim 1, 2 or 8 wherein the spill valve means comprises two of said rotary spill valves and wherein said first means is operable for independently adjusting the relative angular positions of each rotary spill valve member and the rotor as they rotate in unison.

16. A fuel injection pump according to claim 1 wherein the spill valve means comprises a high pressure bore in the rotor connecting the charge pump to said one rotary spill valve and intersecting the valve bore thereof to form a pair of diametrically opposed ports thereto and wherein the rotary spill valve member of said one rotary spill valve has a generally diametral bore aligned to connect the said pair of opposed ports during the supply of each said high pressure charge of fuel.

17. A fuel injection pump according to claim 1 wherein said one rotary spill valve comprises a pair of diametrically opposed ports to the valve bore thereof, and wherein the rotary spill valve member of said one spill valve comprises a pair of diametrically opposed valving lands for simultaneously opening and closing said diametrically opposed ports.

18. A fuel injection pump according to claim 1 wherein the spill control mechanism comprises an accumulator having an accumulator bore in the housing connected to said on rotary spill valve, an accumulator piston mounted in the accumulator bore, spring means at one end of the accumulator bore biasing the accumulator piston in one axial direction thereof, the piston being displaceable in the opposite axial direction thereof against the bias of the spring means to accumulate spilled fuel from the charge pump at the other end of the accumulator bore and said one rotary spill valve serving as an inlet valve to supply accumulated fuel from the accumulator to the charge pump during the intake strokes of the pumping plungers.

19. A fuel injection pump according to claim 18 wherein the accumulator piston has a one-way check valve for supplying fuel through the accumulator piston to the charge pump during the intake strokes of the pumping plungers.

20. A fuel injection pump according to claim 18 wherein the accumulator bore has an outlet port intermediate the ends thereof and wherein the accumulator piston has a peripheral generally helical groove in communication with said one end of the accumulator bore and said outlet port to bypass fuel to said outlet port for cooling the accumulator piston.

21. A fuel injection pump according to claim 1, wherein the rotary spill valve member of at least said one rotary spill valve has at least one peripheral valving land for intermittently opening and closing the rotary spill valve as the spill valve member rotates.

22. A fuel injection pump according to claim 21 wherein the rotary spill valve member of at least said one rotary spill valve has a pair of diametrically opposed, circumferentially spaced, peripheral valving lands for opening and closing the rotary spill valve twice for each rotation of the rotary spill valve member.

23. A fuel injection pump according to claim 21 wherein each said valving land extends axially and has leading and trailing spill control edges, wherein the rotary spill valve member of at least said one rotary spill valve is mounted for axial adjustment within its valve bore and wherein the spill control mechanism comprises second means for axially adjusting each such axially adjustable valve member.

24. A fuel injection pump according to claim 23 wherein the leading and trailing spill control edges of each valving land are non-parallel.

25. A fuel injection pump according to claim 23 wherein the leading and trailing spill control edges of each valving land converge circumferentially toward each other in one axial direction of the rotary valving member.

26. A fuel injection pump according to claim 23 wherein said leading and trailing spill control edges of each valving land extend in the retard circumferential direction in one axial direction of the rotary valving member.

27. A rotary fuel injection pump according to claim 23 wherein the leading spill control edge of each valving land is non-parallel to the axis of the rotary valving member.

28. A rotary fuel injection pump according to claim 1 wherein the axis of at least said one rotary spill valve is parallel to the axis of the rotor.

29. A fuel injection pump according to claim 1, 2 or 8 wherein the spill valve means comprises two of said rotary spill valves connected to the charge pump to provide spill control of successive pilot and main fuel injection phases of each said high pressure charge of fuel.

* * * * *